US006717490B1

(12) United States Patent
Mayer

(10) Patent No.: US 6,717,490 B1
(45) Date of Patent: Apr. 6, 2004

(54) DIELECTRICAL MICROWAVE FILTER

(75) Inventor: Bernd Mayer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/019,863

(22) PCT Filed: Apr. 7, 2000

(86) PCT No.: PCT/DE00/01085

§ 371 (c)(1),
(2), (4) Date: Mar. 5, 2002

(87) PCT Pub. No.: WO00/70706

PCT Pub. Date: Nov. 23, 2000

(30) Foreign Application Priority Data

May 12, 1999 (DE) ..... 199 21 926

(51) Int. Cl.[7] ..... H01P 7/10
(52) U.S. Cl. ..... 333/202; 333/219.1; 333/235
(58) Field of Search ..... 333/202, 219, 333/219.1, 235

(56) References Cited

U.S. PATENT DOCUMENTS 5,059,929 A * 10/1991 Tanaka ..... 333/219.1
5,097,238 A * 3/1992 Sato et al. ..... 333/219.1
5,880,650 A * 3/1999 Latouche et al. ..... 333/202
6,002,311 A * 12/1999 Wey et al. ..... 333/219.1
6,433,652 B1 * 8/2002 Hattori et al. ..... 333/134

FOREIGN PATENT DOCUMENTS

JP 08078903 A * 3/1996 ..... H01P/1/20

OTHER PUBLICATIONS

Wei Ke Hui et al: "Amulticomposite, Multulayered Cylindrical . . . ", International Microwave Symposium Digest (MTT–S), US, New York, IEEE Jun. 1–5, 1992, pp. 929–932.
Patent Abstracts of Japan vol. 1995, No. 9, Oct. 31, 1995 & JP 07 154116 A, Jun. 16, 1995.
Soviet Patents Abstracts Section EI, Week 9413, May 18, 1994 Derwent Publication SLTDA., London, GB & SU 1 793 501 A, Feb. 7, 1993.
"Dielectrical Resonators: Low–Cost . . . ", Components, vol. 22, No. 2, Apr. 1987, pp. 86–87.

* cited by examiner

*Primary Examiner*—Barbara Summons
(74) *Attorney, Agent, or Firm*—Michael J. Striker

(57) ABSTRACT

A dielectric filter has an input and an output for a microwave signal; a rotationally symmetrical single-piece dielectric resonator body that is inducible by a microwave signal to execute electromagnetic oscillations, the resonator body having two different-sized basal surfaces perpendicular to a rotational symmetry axis, the resonator body also having side surfaces which connect the basal surfaces along straight lines.

12 Claims, 3 Drawing Sheets

Fig. 1
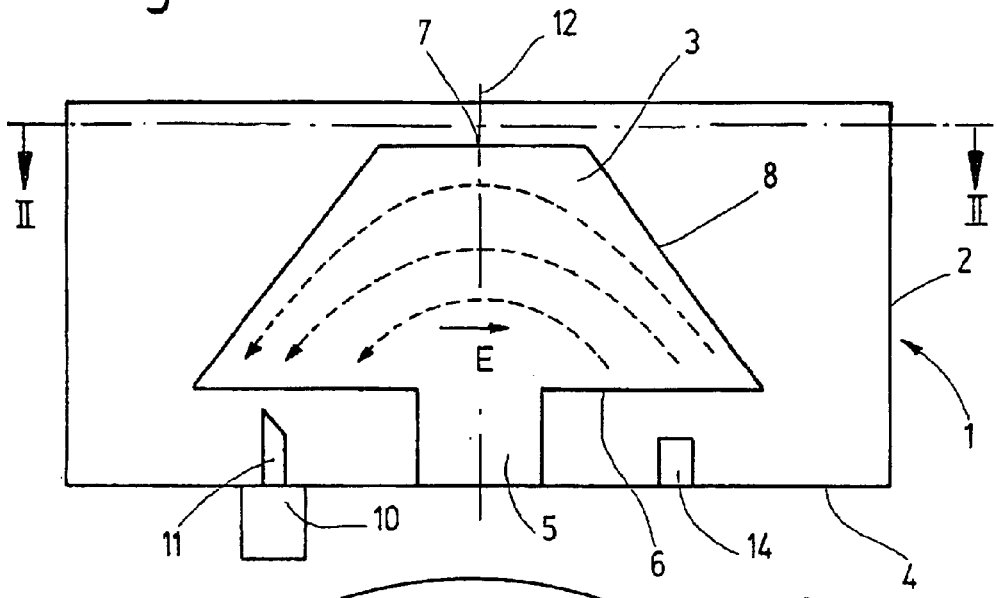
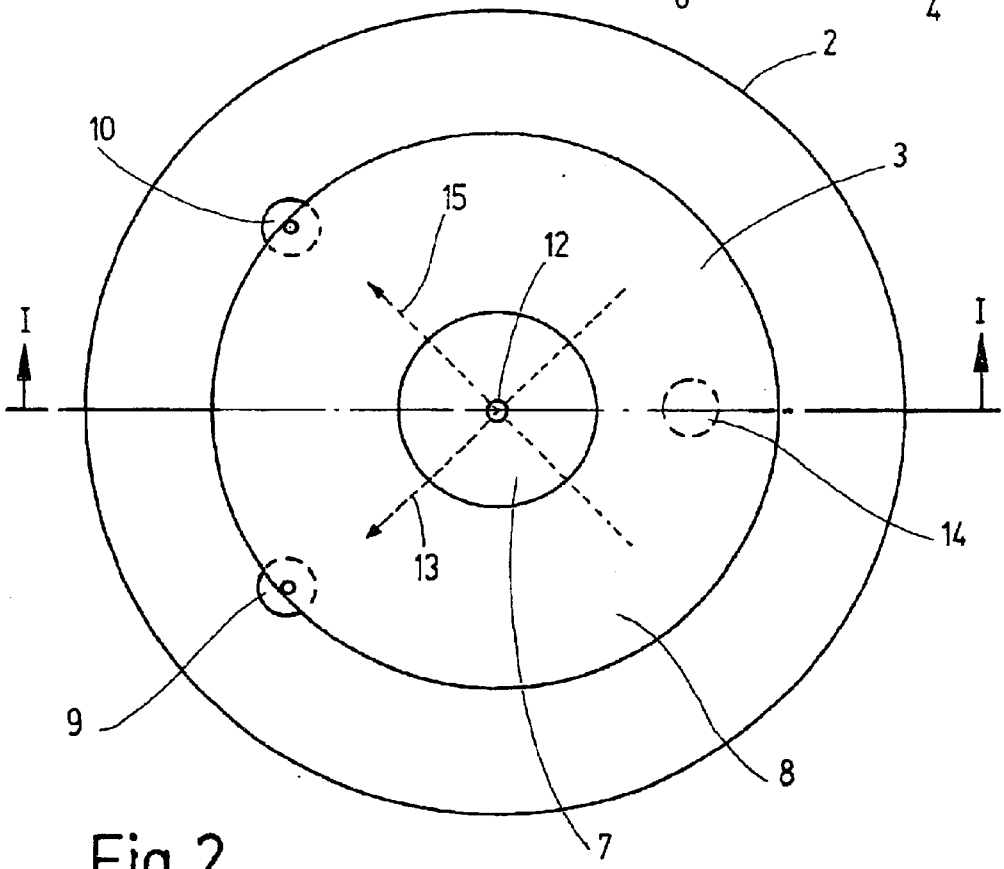
Fig. 2

DIELECTRICAL MICROWAVE FILTER

BACKGROUND OF THE INVENTION

The invention relates to a dielectric filter with an input an output for a microwave signal and a rotationally symmetrical dielectric resonator body that can be induced by the microwave signal to execute electromagnetic oscillations. A filter of this kind is described, for example in DE 196 176 98 C1.

The invention also relates to a method for producing dielectric filters as well as a method for adjusting the mode coupling in dielectric filters.

Filters for high-frequency signals, in particular microwave signals, are used in large numbers in satellites. Due to the very high transport costs of satellite payloads, designers strive to achieve filter functions predetermined by the purpose of the satellite by using filters that are as light in weight and low in volume as possible. Because of the very high qualities required, cavity resonator filters are often used. As described in the reference "Application of Dual TM Mode to Triple and Quadruple-Mode Filters", René R. Bonetti and Albert E. Williams, IEEE Transactions on Microwave Theory and Techniques, vol. MTT-35, No. 12, December 1987, pp. 1143 to 1149, one method for better exploiting the volume is to use dual-mode-, triple-mode-, or quadruple-mode filters. Due to a symmetry of their geometric form, these filters have degenerated modes, one of which is induced via the signal input of the filter. A slight deviation of the filter form from the absolute symmetry achieves a coupling of the induced mode into a degenerated, orthogonal mode. The thus induced mode can—in the case of a dual-mode filter—be read at its output as an output signal or—in the case of higher multiple-mode filters—can be used to induce another degenerated mode. The action of this kind of multiple-mode filter corresponds to a series connection of a number of mono-mode filters in a bridge part of their volume and weight.

Another possibility for reducing the space requirement of filters is to use dielectric work pieces. By using these, the linear dimensions of the filter can be reduced proportional to the square root of the relative permittivity. An example of a filter in which the two methods are combined is disclosed in U.S. Pat. No. 4,489,293 A. However, in comparison to a cavity resonator, reducing the structure produces greater wall currents in the metallic periphery of the filter housing surrounding the dielectric resonator and therefore results in a reduction in resonator quality. Therefore, a compromise is generally required. The limiting metal surfaces are affixed a certain distance from the dielectric.

In order to be able to reduce this distance without having to accept a reduction in resonator quality, it is necessary to find resonator geometries in which the fields of the technically relevant resonator modes emitted by the dielectric resonator body are relatively minor so that they interact only slightly with the surrounding metal surfaces. The reference DE 196 176 98 C1 cited above suggests using a hemisphere as a resonator body. This hemisphere is affixed with its flat surface on a high temperature super-conducting plate. In a variant known from the reference "High Temperature Super-Conductor Shielded High Power Dielectric Dual-mode Filter for Applications in Satellite Communications", S. Schornstein, I. S. Ghosh, and N. Klein, IEEE MTT-S Digest, pp. 1319 to 1322, 1998, a hemispherical resonator body is also used, which is spaced apart from a metallic shielding surface by a pedestal made of dielectric material.

Because of its low dielectric losses, preferably a monocrystalline lanthanum aluminate or the like is used as a material for the resonator body. However, producing a hemispherical dielectric body of this material is not easy for a number of reasons. Since the material is very hard and brittle, the form can only be produced through grinding. In order to grind a precisely curved surface, a high precision, numerically controlled grinding machine must be used. This type of manufacture is very time-consuming and very expensive. The resonance frequency of the resonator body is affected by its form and depends on the relative permittivity of its material. A fine-tuning of this resonance frequency in a hemispherical resonator body is only possible within narrow limits.

Since the relative permittivity of the raw material is subject to fluctuations, a test specimen must of each raw material shipment must be prepared and then the precise geometry of the resonator body to be produced must be defined if a predetermined resonance frequency is to be produced.

SUMMARY OF THE INVENTION

The current invention produces a dielectric microwave filter which can be inexpensively manufactured and can be simply tuned to a required resonance frequency. These advantages are attained in a dielectric filter of the type mentioned at the beginning with the aid of a resonator body which has two different-sized basal surfaces perpendicular to its rotational symmetry axis and has side surfaces which connect the basal surfaces along straight lines. A resonator body of this kind can be produced rapidly and inexpensively by means of a simple circular grinding and/or face grinding.

The proportions of the basal- and side surfaces are suitably chosen so that the resonator body resembles a hemisphere in order to achieve a mode structure of the natural oscillations of the resonator body which resembles that of a hemisphere and has correspondingly few field components outside the resonator body.

In a simple embodiment, the resonator body can be in the form of a truncated cone or a truncated pyramid with a number of sides that is in principle arbitrary.

On one of its basal surfaces, preferably the large basal surface, the resonator body preferably has a pedestal which serves to fasten the resonator body in a housing, with a spacing between a metallic housing wall and the basal surface that has the pedestal.

Preferably, the filter according to the invention is a multiple-mode filter. A screw, which is fastened in the housing of the filter and engages in an inner chamber of the filter encompassing the resonator body, can serve in the usual manner as a symmetry interrupting element or mode coupler. However, a symmetry interruption can also be produced by virtue of the fact that one of the basal surfaces of the resonator body, at least in part, extends at a slight inclination in relation to the other basal surface.

In the effective frequency band of a dielectric filter, there can also be higher oscillation modes whose fields are concentrated in the vicinity of the surface of the resonator body. Modes of this kind are heavily influenced by the surroundings of the resonator body, in particular by the housing, and are thus poorly suited to filtering applications. In order to suppress such modes or to shift them out of the effective frequency band, dielectric material can be locally applied to and/or removed from the resonator body. Such local changes have only a slight influence on modes whose fields are concentrated on the interior of the resonator body.

A dielectric body with at least one flat basal surface, such as the resonator body of the filter according to the invention, is well-suited in terms of the fine-tuning of its resonance frequency through the removal of material from the basal surface. It is therefore possible to mass produce resonator bodies of this kind as blanks; in these blanks, dispersions of the resonance frequency, for example due to differences in the relative permittivity of the raw material, can be taken into account and each blank can then be fine-tuned to a desired resonance frequency through the removal of material from the basal surface.

Other features and advantages of the invention ensue from the following description of exemplary embodiments.

BRIEF DESCRIPTION OF THE DRAWINGS

FIG. 1 is an axial section through a dielectric filter according to the invention;

FIG. 2 shows the filter in a section along the line II—II in FIG. 1;

DESCRIPTION OF THE PREFERRED EMBODIMENTS

Figure 3:
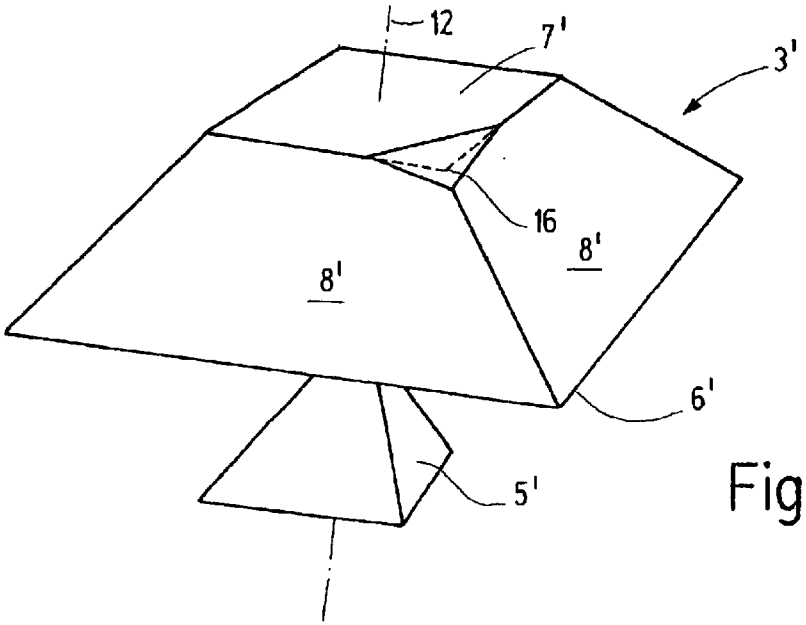
FIG. 3 is a perspective view of a resonator body according to a second embodiment of the invention.

FIGS. 1 and 2 show sections through a filter 1 according to the invention, in this instance a dual-mode, two-terminal filter. Lines II—II in FIG. 1 and I—I in FIG. 2 each indicate the intersecting plane of the respective other figure.

The filter 1 has a cylindrical metallic shield housing 2. A resonator body 3 made of lanthanum aluminate is disposed inside the housing 2 and is connected to its bottom 4 by means of a pedestal 5 which is embodied of one piece with the resonator body 3.

The resonator body 3 has the form of a truncated cone with a larger basal surface 6, a smaller basal surface 7, and a side surface 8 which extends in a straight line in the cross section according to FIG. 1 and has the form of the envelope of a cone. The proportions of the surfaces 6, 7, 8 are chosen so that the modes supported by the resonator body 8 are similar to those of a hemispherical body, the diameter of the small basal surface 7 and the height of the resonator body 8 each lie in the range of 0.4 to 0.6 times the diameter of the large basal surface 6. For a working frequency of the filter, this can, for example, lie in the range from 23 to 25 mm.

An input 9 and an output 10 for a microwave signal extend through the bottom 4 of the housing 2. They have the form of coaxial cables with an inner conductor 11 which passes through the housing 2 and ends inside the housing, spaced slightly apart from the large basal surface 6 of the resonator body.

The resonator body 3 has a rotational symmetry axis 12. A field with an electrical field vector 13 is induced in the resonator body 3 via the input 9 and is oriented along the connection between the input 9 and the symmetry axis 12, as can be seen particularly in the top view of the resonator body 3 in FIG. 2. A screw 14 engaging through the bottom 4 into the housing interior acts as a mode coupler which interacts with the component of the mode induced via the input 9, is disposed outside the resonator body, and thus interrupts the symmetry of the filter 1 and produces a transition from microwave energy into a mode with the field vector 15 that is orthogonal to the induced mode. Microwave energy from this mode is coupled out via the output 10 of the filter.

FIG. 3 is a perspective view of a variant of a resonator body for a dielectric filter. This resonator body 3' has the form of a truncated pyramid with square basal surfaces 6', 7' and four side surfaces 8'. A pedestal 5' is likewise embodied in the form of a smaller truncated pyramid. This resonator body also has a rotational symmetry axis 12 which is tetrad so that the resonator body 3' supports orthogonal sets of degenerated modes.

In order to produce a coupling between the sets of modes, the small basal surface 7 is obliquely ground in one corner 16. The inclination could also extend over the entire small basal surface 7'.

A mode coupling through the inclination of a basal surface in lieu of using a screw is naturally also possible in the filter from FIGS. 1 and 2.

The number of side surfaces of the resonator body 3' can naturally also be greater than 4. The greater the number of side surfaces, the greater the resemblance to the variant proposed in FIG. 1.

According to a variant that is not shown, the resonator body can also be embodied in one piece of two or more stacked, truncated cones or pyramids so that a side surface is produced which connects the basal surfaces along two or more straight lines. This permits a better approximation of the hemispherical form.

Figure 4:
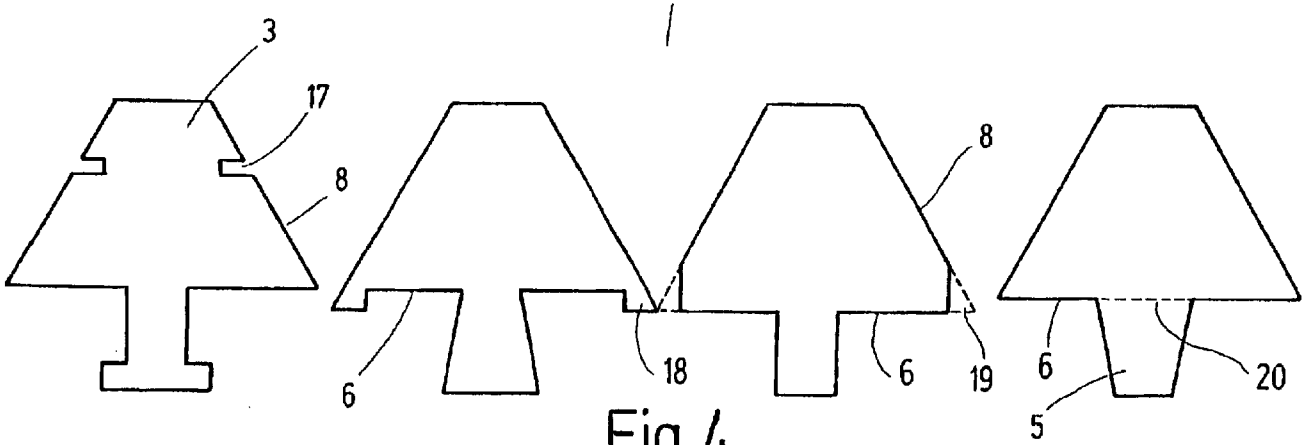
FIG. 4 shows cross sections through resonator bodies that have been machined to suppress undesirable modes.

As with any other resonator, infinitely numerous oscillation modes are also possible in the resonator bodies of FIGS. 1, 2, and 3. This becomes problematic when the resonance frequency of a higher mode falls within the effective band. Special steps must then be taken to suppress this interfering mode or to shift it out of the effective band. Some of these measures are shown in FIG. 4. These measures include, for example, the grinding of a groove 17 into the side surface 8 of the resonator body 3, the elongation of the side surface 8 beyond the large basal surface 6 through the attachment of a ring 18, the truncation of the sharp edges 19 between the side surface 8 and the larger basal surface 6, or the enlargement of the transition cross section 20 between the large basal surface 6 and the pedestal 5 that is of one piece with it.

All of these measures influence the effective modes only slightly. From among the possible oscillation modes of the resonator body, namely those in which the greater portion of the electromagnetic field is disposed inside the resonator body 3 are selected as effective modes. This property is also crucial to the fact that these modes are only slightly damped by the metallic housing so that extremely high qualities can be achieved with these modes. In the interfering modes, though, a significant portion of the field is also disposed at the edge of the dielectric. As a result, these modes are heavily influenced by the measures depicted.

Figure 5:
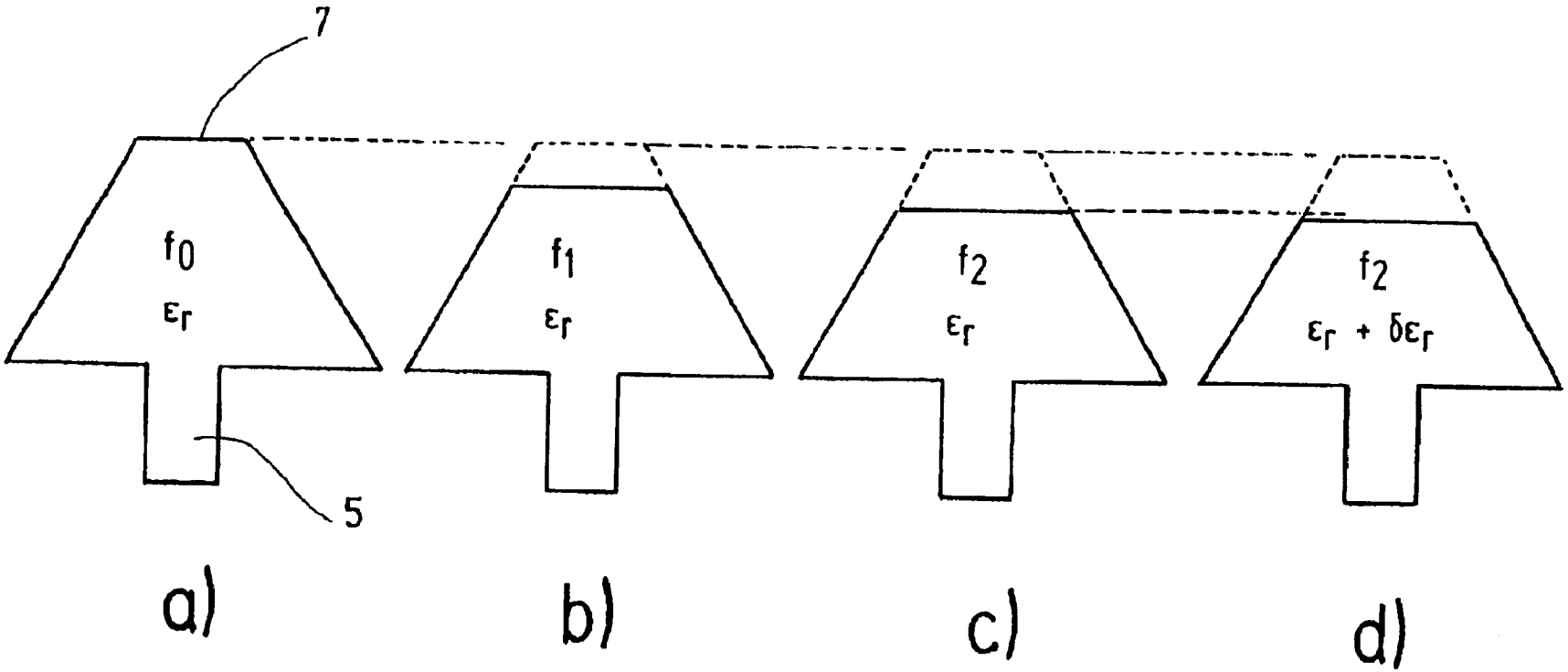
FIG. 5 shows the tuning of the dielectric filter to a given resonance frequency.

FIG. 5 shows the production of dielectric filters with exactly predetermined resonance frequencies according to the invention. In a first step, the blank shown in FIG. 5*a* is ground out of a dielectric material such as monocrystalline lanthanum aluminate. With a relative permittivity of $\in_r$, this blank has a resonance frequency $f_0$. In order to tune this blank to a resonance frequency $f_1$, or $f_2$, predetermined for a particular application, it is sufficient to grind away material from the basal surface 7 remote from the pedestal 5, which increases the resonance frequency. The grinding is continued until the resonance frequency of the body 3 corresponds to the desired frequency. If dielectric material with a slightly divergent relative permittivity $\in_r+\delta\in_r$ is machined at a later time, then a blank with the dimensions shown in FIG. 5*a* can still be the first step in production. In order to likewise tune this blank to the predetermined resonance frequency $f_2$, it is sufficient to further abrade its small basal surface 7 slightly, as shown in FIG. 5*c* (also see FIG. 5*d*). In connection with the tuning, the inclination of the basal surface 7 described in connection with FIG. 3 can also be suitably produced for purposes of mode coupling.

Aside from the basal surface 7, other surfaces of the resonator body no longer have to be machined. The blank can therefore be inexpensively mass produced and stored. A filter with the desired resonance frequency can then be produced with great flexibility and rapidity.

In particular, all filters for a multiplexer can be produced from a single blank form. As a result, the delivery time for such a multiplexer can be significantly reduced because once the frequency planner has been announced by the client, the dielectric bodies for all channels can be rapidly produced by grinding one surface.

In order to remove material from the basal surface 7, the same intrinsically known machining methods used in the production of the blank itself can be used, such as abrasive band-grinding, honing, or lapping.

What is claimed is:

1. A dielectric filter, comprising an input and an output for a microwave signal; a rotationally symmetrical single-place dielectric resonator body that is inducible by a microwave signal to execute electromagnetic oscillations, said resonator body having two different-sized basal surfaces perpendicular to a rotational symmetry axis, said resonator body also having side surfaces which connect said basal surfaces along straight lines.

2. A dielectric filter as defined in claim 1, wherein said resonator body is formed as a truncated cone.

3. A dielectric filter as defined in claim 1, wherein said resonator body is formed as a truncated pyramid.

4. A dielectric filter as defined in claim 1; and further comprising a housing, one of said basal surfaces of said dielectric resonance body having a pedestal for fastening said resonator body in said housing.

5. A dielectric filter as defined in claim 1, wherein said input and output in said dielectric resonator body are formed so that the dielectric filter is a multiple-mode filter.

6. A dielectric filter as defined in claim 1, wherein said input and output of said dielectric resonator body are formed so that the dielectric filter is a dual-mode filter, one of said basal surfaces being slightly inclined relative to the other of said basal surfaces in order to provide a mode coupling.

7. A dielectric filter as defined in claim 1, wherein said dielectric resonator body has a local area in which a dielectric material quantity is different from a dielectric material body of a main part of said dielectric resonator body in order to suppress undesirable modes or to shift their frequency.

8. A dielectric filter as defined in claim 7, wherein in said local area of said resonator body the dielectric material is locally applied on said resonator body.

9. A dielectric filter as defined in claim 7, wherein in said local area of said resonator body the dielectric material is locally removed on said resonator body.

10. A method of producing a dielectric filter, comprising the steps of providing an input and an output for a microwave signal; arranging a rotationally symmetrical dielectric resonator body that is inducible by a microwave signal to execute electromagnetic oscillations; and providing the resonator body with two different-sized basal surfaces perpendicular to a rotational symmetry axis; and connecting said basal surfaces by side surfaces along straight lines.

11. A method as defined in claim 10; and further comprising prefabricating the dielectric resonator body so that it has a resonance frequency that is lower than a predetermined resonance frequency in order to be able to adjust the resonance frequency of the dielectric resonator body through a removal of material from at least one of the basal surfaces until it corresponds to the predetermined resonance frequency.

12. A method as defined in claim 10; and further comprising adjusting a mode coupling in the dielectric resonator body by inclining one of the basal surfaces.

* * * * *